United States Patent [19]

Barnett

[11] Patent Number: 4,799,710

[45] Date of Patent: Jan. 24, 1989

[54] SKI ATTACHMENT FOR PROTECTING THE UPPER SURFACE OF THE REAR PORTION OF A SKI

[76] Inventor: Thomas R. Barnett, 7 Mountsfield Drive, London, Ontario, Canada, N6C 2S3

[21] Appl. No.: 118,583

[22] Filed: Nov. 9, 1987

[51] Int. Cl.[4] ..... A63C 11/00

[52] U.S. Cl. ..... 280/809; 280/817

[58] Field of Search ..... 280/809, 811, 608, 817; D8/47; 350/286 T

[56] References Cited

U.S. PATENT DOCUMENTS

| | | | |
|---|---|---|---|
| 71,309 | 11/1867 | Kane | 350/286 |
| 3,148,891 | 9/1964 | Heuvel | 280/817 |
| 3,424,469 | 1/1969 | Hooker | 280/608 |
| 3,820,802 | 1/1974 | Davis | 280/601 |
| 3,863,944 | 2/1975 | Waddel | 280/817 |
| 3,885,805 | 5/1975 | Solgmosi | 280/817 |
| 3,933,360 | 1/1976 | Arai | 280/609 |
| 4,211,433 | 7/1978 | Pedersen | 280/609 |

*Primary Examiner*—David M. Mitchell
*Assistant Examiner*—Richard Camby

[57] ABSTRACT

A ski attachment for protecting the upper surface of a rear portion of a ski is formed as a rigid body of hard impact resistant material having a base securable to the upper surface of a rear surface of a ski. The body is generally triangular in side view with a substantially flat rear face extending upwardly and forwardly from a rear base edge at an angle in the range of from about 35° to about 50° to the base to a vertical height above the base in the range of from about 0.375 to about 0.875 inches.

7 Claims, 3 Drawing Sheets

SKI ATTACHMENT FOR PROTECTING THE UPPER SURFACE OF THE REAR PORTION OF A SKI

Figure 1:
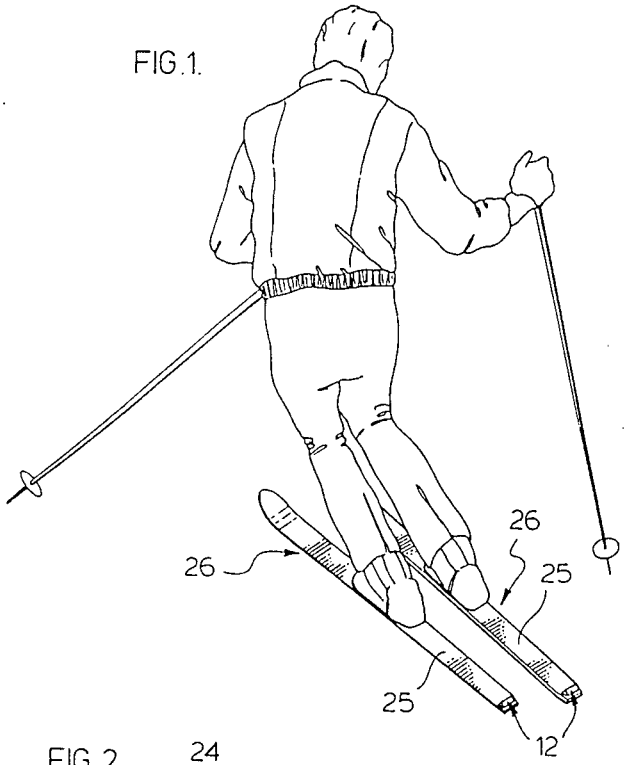

This invention relates to attachments for protecting the upper surfaces of rear portions of skis.

It is known to secure attachments to the upper surfaces of rear portions of skis to prevent or help to prevent a person learning to ski from allowing the rear portion of a pair of skis to cross over one another, this being a common problem for ski learners. Attachments for this purpose are shown for example in U.S. Pat. No. 3,863,944 (Waddel) issued Feb. 4, 1975 and U.S. Pat. No. 3,885,805 (Solymosi) issued May 27, 1975.

However, attachments such as those mentioned above are not intended to cope with another problem which can affect all skiers, namely the likelihood of the following skier in a line up or a ski tow inadvertently moving forward in the line up too soon so that the front portions of the skis of the following skier ride up over and damage the upper surfaces of the rear portions of the skis of the person in fromt in the line up. In addition to the physical difficulty likely to be caused to the skier in front, there is also the likelihood of the rear portions of the skis of the skier in front being scratched by the front portions of the following skis, with unsightly results which are especially unwanted if the skis are of the expensive kind.

It is therefore an object of the invention to provide an attachment for the upper surface of the rear portion of a ski which is especially effective in preventing or helping to prevent problems such as those mentioned above caused by a following ski.

According to the present invention, a ski attachment comprises a rigid body of hard impact resistant material having a base securable to the upper surface of a rear surface of a ski, said body being generally triangular in side view with a substantially flat rear face extending upwardly and forwardly from a rear base edge at an angle in the range of from about 35° to about 50° to the upper surface of the ski when the attachment is secured thereto to a vertical height above the upper surface of the ski when the attachment is secured thereto in the range of from about 0.375 to about 0.875 inches.

The body may have substantially flat generally triangular side faces at opposite ends of the rear face which are upwardly and laterally inwardly inclined to the upper surface of the ski when the attachment is secured thereto at an angle in the range of from about 60° to about 85°.

The side faces may diverge in a forward direction when the body is attached to the upper surface of the ski with an included angle in the range from about 5° to about 15°.

The body may be a rigid body of hard impact resistant synthetic plastic material with said substantially flat rear face, a substantially flat base face, a substantially flat front face extending downwardly and forwardly from an upper edge of the rear face to a front face edge, and substantially flat generally triangular side faces extending between the base, rear and front faces at opposite ends of the body.

Figure 2:
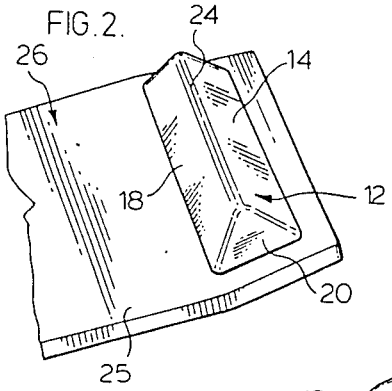
Figure 3:
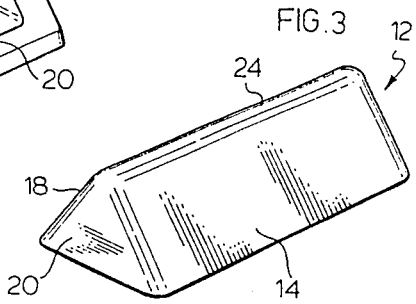
Figure 4:
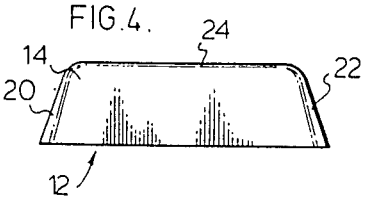
Figure 5:
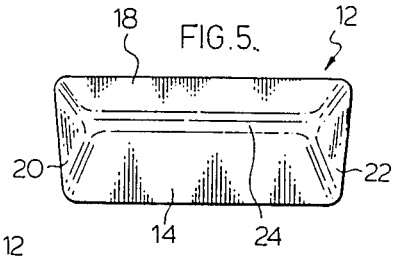
Figure 6:
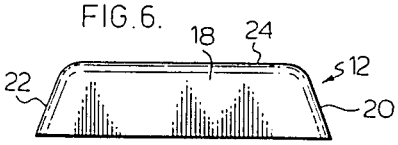
Figure 7:
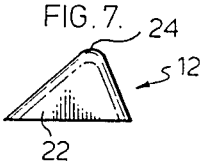
Figure 8:
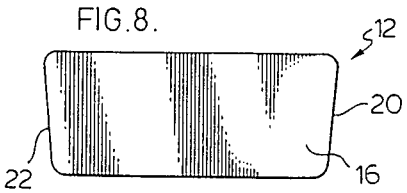
Figure 9:
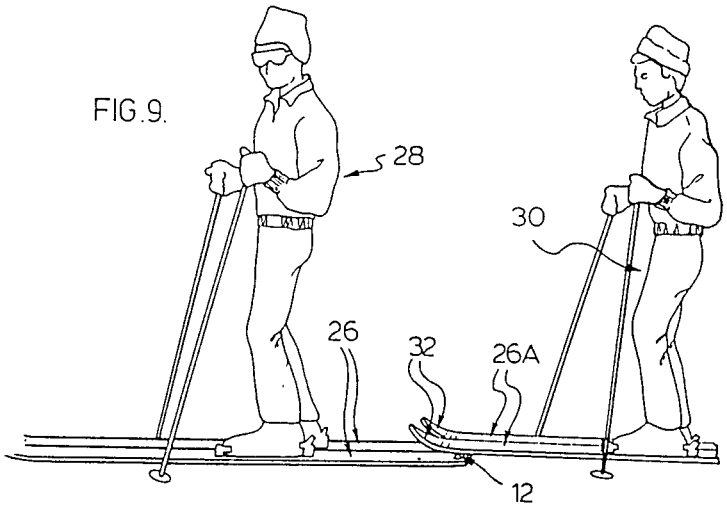
Figure 10:
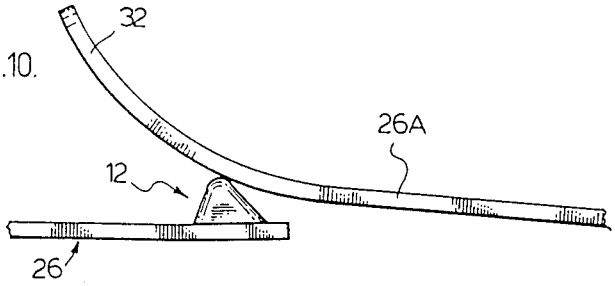
Figure 11:
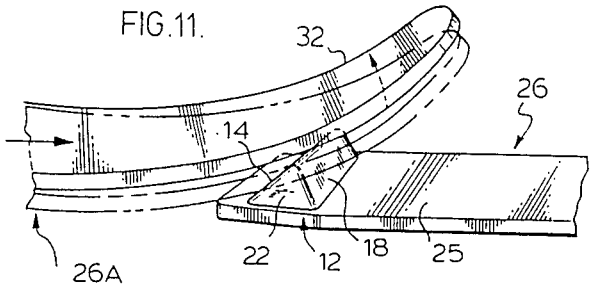
Figure 12:
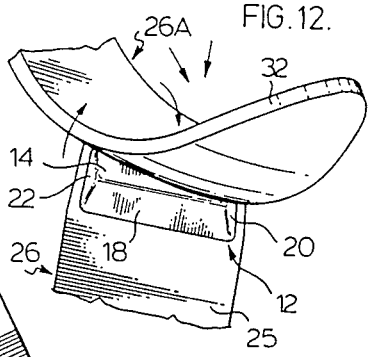
Figure 13:
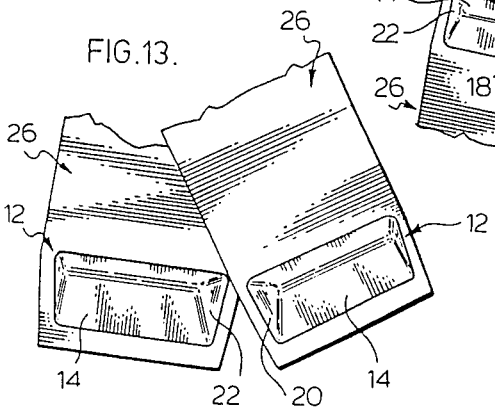

Embodiments of the invention will now be described, by reference to the accompanying drawings, of which:

FIG. 1 is a perspective view of a skier with skis having attachments in accordance with the invention secured thereto, FIG. 2 is an enlarged view of a portion of the ski showing the attachment in greater detail, FIG. 3 is a perspective view of the attachment, FIG. 4 is a rear view, FIG. 5 is a plan view, FIG. 6 is a front view, FIG. 7 is a side view, FIG. 8 is a bottom view, FIG. 9 is a side view showing the forward portions of the skis of a following skier riding up over the attachments on the rear portions of the skis of a preceding skier, FIG. 10 is an enlarged view of the forward portion of a following ski riding up over the attachment on the rear portion of a preceding ski, FIG. 11 is a diagramatic view showing the effect of the vertical flexibility of the front portion of the following ski as it rides up over a ski attachment on the rear portion of a preceding ski, FIG. 12 is a side view showing the effect of the torsional flexibility of the front portion of a following ski as it rides up over an attachment on the rear portion of a preceding ski, and FIG. 13 is a side view showing how the attachments facilitate release from the situation which results when a skier inadvertently allows the rear portions of skis worn by the skier to become crossed.

Referring to the drawings, a ski attachment comprises a rigid solid body 12 formed as a molding of hard impact resistant synthetic plastic material, for example Neoprene PHB 4962 sold by 3M of Minnesota, United States of America. The body 12 is substantially angular in side view and has a flat rear face 14, a flat base face 16, a flat front face 18 and flat side faces 20, 22 at opposite ends. The junctions between the various faces are rounded, except the junctions between the base face and the other faces which are relatively sharp edges.

In the preferred embodiment, the rear face 14 is 0.9 inches long and extend upwardly and forwardly from the rear edge of the base face 16 at an angle of 45° so that the top edge 24 of the body 12 has a height of 0.6 inches above the base face 16. The front face 18 is 0.7 inches long and extends downwardly and forwardly from the top edge 24 to the base face 16 at an angle to the base face 16 of 70°. The base face 16 has a length of 0.875 inches from front to rear. Each side face 20, 22 extends upwardly and laterally inwardly at an angle to the base face 16 which reduces in a forward direction from 82° to 73°. Also, the side faces 20, 22 diverge in a forward direction with an included angle of 10°. The width of the base face 16 is 2.25 inches at the rear and 2.4 inches at the front. The width of the upper edge 24 is 2.0 inches.

The attachment 12 is secured to the upper surface of a ski 26 at the rear end with any suitable adhesive such that the attachment 12 extends transversely over substantially the whole width of the ski at the rear end thereof.

FIGS. 9 to 11 show a skier 28 wearing skis 26 with attachments 12 secured thereto, and a following skier 30 wearing skis 26A standing directly behind the skier 28, for example in a ski tow line up. Following skier 30 has advanced too far, with the result that the forward portions 32 of the following skis 26A have ridden up over the attachments 12. As shown especially in FIG. 11, the angle of inclination and the length of the rear face 14 of each attachment in conjunction with resultant resilient vertical flexing of the forward ski portions 32, not only prevent damage to the upper surfaces 25 of the skis 26 but also prevent engagement of the skis 26A with the attachments 12 on skis 26 from merely applying forward "shoving" force to the skis 26, thereby minimising annoyance to the skier 28. In FIG. 11, the forward portion 32 of the ski 26a is shown in full lines in its flexed position and in dotted lines in its normal unflexed position.

FIGS. 12 shows the effect if the following ski 26a engages the attachment 12 of a ski 26 from the rear in a direction other than from directly behind the ski 26. In this case, the rear surface 14 of the attachment 12 deflects the ski 26a to change the direction of momentum of the following skier, with such deflection being assisted by torsional resilient deformation of the forward portion 32 of the ski 26A.

The side faces 20, 22 are also of assistance in deflecting a following ski 26A which engages the attachment 12 from the rear in a direction other than from directly behind. The side faces 20, 22 because of their inclination also facilitate release of the skis 26 by a skier if the rear portions become completely crossed as shown in FIG. 13. The inclination of the engaged side face 22 of the left hand attachment 12 facilitates upward movement of the rear portion of the right hand ski 26.

Although in the preferred embodiment attachment 12 is formed as a single body of material, it is possible to form the attachment as two laterally spaced body portions separated by a central gap.

Other advantages and also other embodiments of the invention will be readily apparent to a person skilled in the art, the scope of the invention being defined in the appended claims.

I claim:

1. A combination of a ski having an upper surface and a rear end and an attachment secured to the upper surface of the ski adjacent the rear end thereof, said attachment comprising a rigid body of hard impact resistant material having a base secured to the upper surface of said ski, said body being generally triangular in side view with a substantially flat rear face extending upwardly and forwardly from a rear base edge at an ange in the range of from 35° to 50° to the upper surface of the ski to a vertical height above the upper surface of the ski in the range of from 0.375 to 0.875 inches.

2. A combination according to claim 1 wherein the body of the attachment has substantially flat generally triangular side faces at opposite ends of the rear face which are upwardly and laterally inwardly inclined to the upper surface of the ski at an angle in the range of from 60° to 85°.

3. A combination according to claim 2 wherein the side faces of the attachment diverge in a forward direction with an included angle in the range from 5° to 15°.

4. A combination according to claim 1 wherein the body of the attachment is a rigid body of hard impact resistent synthetic plastic material with said substantially flat rear face, a substantially flat base face, a substantially flat front face extending downwardly and forwardly from an upper edge of the rear face to a front face edge, and substantially flat generally triangular side faces extending between the base, rear and front faces at opposite ends of the body.

5. A combination according to claim 4 wherein the body of the attachment has substantially flat generally triangular side faces at opposite ends of the rear face which are upwardly and laterally inwardly inclined to the upper surface of the ski at an angle in the range of from 60° to 85°.

6. A combination according to claim 5 wherein the side faces of the attachment diverge in a forward direction with an included angle in the range from 5° to 15°.

7. A combination according to claim 1 wherein the attachment extends across substantially the whole width of the ski.

* * * * *